US008270652B2

(12) United States Patent
Caldes et al.

(10) Patent No.: US 8,270,652 B2
(45) Date of Patent: Sep. 18, 2012

(54) INTEGRATED TELEVISION MOUNT AND AUDIO SYSTEM

(75) Inventors: Douglas G. Caldes, Orlando, FL (US); Raymond I. Leake, Debary, FL (US)

(73) Assignee: Metra Electronics, Corp., Holly Hills, FL (US)

( * ) Notice: Subject to any disclaimer, the term of this patent is extended or adjusted under 35 U.S.C. 154(b) by 0 days.

(21) Appl. No.: 13/276,794

(22) Filed: Oct. 19, 2011

(65) Prior Publication Data

US 2012/0134523 A1 May 31, 2012

Related U.S. Application Data

(63) Continuation-in-part of application No. 12/955,180, filed on Nov. 29, 2010.

(51) Int. Cl.
*H04R 1/02* (2006.01)

(52) U.S. Cl. ..... 381/333; 381/361; 381/366; 381/374; 381/386; 381/87; 381/334; 381/388; 181/148; 181/150

(58) Field of Classification Search ..... 381/361, 381/366, 374, 386, 87, 334, 333, 388; 181/148, 181/150

See application file for complete search history.

(56) References Cited

U.S. PATENT DOCUMENTS

| | | | | |
|---|---|---|---|---|
| 5,150,418 | A * | 9/1992 | Honda et al. | 381/349 |
| 7,269,912 | B2 | 9/2007 | Muday et al. | |
| 7,796,772 | B2 * | 9/2010 | Takahashi et al. | 381/333 |
| 2005/0058316 | A1 * | 3/2005 | Yanagishita et al. | 381/371 |
| 2005/0185801 | A1 * | 8/2005 | McCarty et al. | 381/87 |
| 2006/0008103 | A1 | 1/2006 | Takahashi et al. | |
| 2007/0262215 | A1 | 11/2007 | Tan | |
| 2007/0274547 | A1 | 11/2007 | Ueno | |
| 2008/0304693 | A1 | 12/2008 | Lau | |
| 2009/0196455 | A1 | 8/2009 | Lee | |
| 2010/0150390 | A1 | 6/2010 | Nishiyama et al. | |
| 2010/0183186 | A1 | 7/2010 | Noguchi et al. | |
| 2011/0198461 | A1 | 8/2011 | Truckor | |

FOREIGN PATENT DOCUMENTS

| | | |
|---|---|---|
| JP | 2009232134 | 10/2009 |

* cited by examiner

*Primary Examiner* — Disler Paul
(74) *Attorney, Agent, or Firm* — J. Wiley Horton

(57) ABSTRACT

A television mount incorporating an integrated audio system. The mount attaches the television to a wall or a pedestal. The mount includes an electronics/subwoofer enclosure. This enclosure house an audio amplifier and a low-range speaker. One or more external speakers are attached to a speaker assembly which is connected to the mount—preferably by attaching the supports to the electronics/subwoofer enclosure. The speaker supports is preferably made adjustable so that the degree of extension from the mount may be adjusted by the user.

20 Claims, 17 Drawing Sheets

INTEGRATED TELEVISION MOUNT AND AUDIO SYSTEM

CROSS-REFERENCES TO RELATED APPLICATIONS

This application is a continuation-in-part of U.S. patent application Ser. No. 12/955,180, which was filed on Nov. 29, 2010. The parent application listed the same inventors.

STATEMENT REGARDING FEDERALLY SPONSORED RESEARCH OR DEVELOPMENT

Not Applicable

MICROFICHE APPENDIX

Not Applicable

BACKGROUND OF THE INVENTION

1. Field of the Invention

This invention relates to the field of audio-visual systems. More specifically, the invention comprises a display mount incorporating an integrated audio system.

2. Description of the Related Art

Throughout this disclosure the terms "television" and "video display" are used synonymously. While some persons previously drew a distinction between these two terms on the basis of whether the particular unit included a tuner, this distinction no longer makes sense as most displays now have the ability to serve multiple purposes (such as the ability to serve as a computer monitor and a display of cable television programming). In any event, the integrated display and audio system disclosed in the present invention functions equally well for any of these units.

Video displays are now commonly used for both residential and commercial purposes. The technology underlying these displays has changed dramatically over the past several years. Picture-tube based displays were previously the standard. Such displays were inherently bulky, with the depth of the unit being comparable to its other dimensions. While the bulk made the units visually unappealing, space within the cabinetry did provide ample volume for the inclusion of integrated audio systems. A picture-tube television having a diagonal frontal dimension of 40 inches (about 100 centimeters) typically had a cabinet depth of about 30 inches (about 75 centimeters).

With the advent of modern electronics and their inherent space efficiency, much of the cabinet space available in picture-tube televisions was left vacant. A television manufacturer could easily place relatively large speakers (such as 4 inches by 6 inches) in the vacant space within the cabinet. Speakers of this size provided a rich tonal quality to the sound produced.

The prior art changed dramatically when tube-less designs appeared. These are generally referred to as "flat screen" televisions. Examples include liquid crystal displays ("LCD's") and plasma displays. Flat screen televisions are typically very thin. In fact, limiting the depth of a flat screen television has become a styling goal for most manufacturers. A flat screen television with a diagonal frontal dimension of 40 inches (100 centimeters) may have a depth of less than two inches (5 centimeters). The television's perimeter is typically made even thinner. The perimeter is often less than one inch (2.5 centimeters) thick.

The visual performance of modern flat screen televisions is a significantly better than picture-tube based televisions. However, the limited space within the "cabinet" of a flat screen (to the extent one can even call such a thin structure a cabinet) leaves very little room for audio components. The lack of space has forced flat screen manufacturers to use increasingly smaller audio transducers.

Another styling goal of the flat screen manufacturers has been to occupy as much of the forward-facing surface as possible with the video display itself. Thus, the audio transducers which are present are often now in a sub-optimal orientation; that is, the speaker cones face to the side or even to the rear of the television and do not direct the sound energy toward the user. The result is that—while the video performance of these devices has progressed markedly—the audio performance has at best remained stagnant and has in most instances deteriorated.

A consumer buying a high-performance flat screen television often desires a "home theater" experience in which the sound quality is comparable in volume and range to the sound heard in a movie theater. Such a consumer will not be satisfied with the limited acoustic performance of a modern flat screen television. The consumer must therefore bring in additional components to solve this problem.

Audio solutions for home theater systems are widely varied and complex. FIG. 1 gives one simple example. Flat screen display 10 has been mounted on a wall using one of the available mounting systems. Separate components are housed in rack 24 (which may be anything from a simple electronics rack to an elegant piece of furniture designed specifically to conceal the components). Rack 24 typically encloses a cable or satellite decoder box, a DVD player, a video game console, and an amplifier 12. The amplifier may be a sophisticated PRO/LOGIC decoding system (such as offered by Dolby Laboratories of San Francisco, Calif.) that splits the audio signal into at least four channels—typically referred to as left, center, right, and rear (The rear channel sometimes known as a "subwoofer" channel).

Cables run between rack 24 and flat screen display 10. In this example, a two channel audio cable 14 is run from the television to amplifier 12. In other examples, a single HDMI cable may be connected from the cable box to the amplifier, with a second HDMI cable running from the amplifier to the television. These represent a hard-wired connection between the amplifier and the television.

The speakers are also connected to the amplifier. Left channel speaker 22 is connected via speaker cable 26. Center channel speaker 16 is connected via its own cable (not visible in the view). Right channel speaker 20 and subwoofer 18 are also connected to the amplifier via speaker cables 26.

The system shown in FIG. 1 produces reasonably good audio performance. However, the reader may easily perceive the irony of the situation. In creating ever-thinner flat screen televisions the manufacturers have created an elegant and "clean" appearance for the visual aspects of a home entertainments system. However, in so doing, they have reduced the audio performance of the television itself to an unacceptably low level. The typical response to this problem is the addition of numerous other components and cables which completely destroy the visual aesthetic originally sought.

The present invention seeks to resolve this dilemma by integrating an external audio system into the television's mount. The reader will benefit from an understanding of existing mounting technology. Modern television mounts attach to the rear of the television or the base of the television. The volume immediately behind the television is typically not used. FIG. 2 represents a common wall mounting system for a television. In this example, wall bracket 28 is attached to the wall by passing bracket mounting bolts 36 through the bracket and into the wall studs or masonry. Uprights 32 on TV bracket 30 are attached to the rear of the flat screen television by passing TV mounting bolts 34 through the uprights and into the television. TV bracket 30 is then slidably engaged with wall bracket 28 (with the television attached).

Many other mounting systems exist. The TV bracket in some of these other systems attaches to the wall bracket by pivoting into position rather than sliding. The general concept of having a first portion attached to the wall and a second portion attached to the television is used in nearly every prior art mounting system, and it is in fact preferable to use this approach for the present invention as well.

A significant gap typically remains between the rear of the television and the wall itself. This gap is mostly occupied by the mount itself. The present invention seeks to take advantage of this potentially available space by creating a mounting system with at least a portion of an integrated high-fidelity audio system in this space.

BRIEF SUMMARY OF THE INVENTION

The present invention comprises a video display mount incorporating an integrated audio system. The mount attaches the display to a wall. Alternatively, the mount incorporates a pedestal so that the display and associated audio devices may be placed upon a flat surface. A main bracket and display bracket of suitable design are included. As for the prior art, the main bracket may be attached to the wall and the television bracket attached to the video display. The two components are preferably designed to easily engage so that the user may hang the television on the wall without the need for complex operations.

The main bracket mounts an electronics/subwoofer assembly. This assembly houses an audio amplifier (which may be a sophisticated frequency splitting device such as a PRO/LOGIC system) and a low-range speaker or speakers. A resonance chamber and bass port are preferably included in the electronics/subwoofer assembly so that the low-range speaker can accurately project the low-frequency portion of the audio spectrum.

One or more external speaker supports are included in the mount—preferably by attaching the supports to the electronics/subwoofer assembly. The speaker supports are preferably made adjustable so that the degree of extension from the mount may be adjusted by the user.

In the preferred embodiment a single speaker support is provided for an integrated assembly containing a left speaker, a center speaker, and a right speaker. In some embodiments the lateral location of the speakers is made adjustable. The speakers may be wired to the electronics housed within the electronics/subwoofer assembly. The signal to each speaker may also be transmitted wirelessly if desired. The result is an integrated audio/video system in which all components are located together in one aesthetically clean package.

REFERENCE NUMERALS IN THE DRAWINGS

| | | | |
|---|---|---|---|
| 10 | flat screen display | 12 | amplifier |
| 14 | audio cables | 16 | center channel speaker |
| 18 | subwoofer | 20 | right channel speaker |
| 22 | left channel speaker | 24 | rack |
| 26 | speaker cable | 28 | wall bracket |
| 30 | TV bracket | 32 | upright |
| 34 | TV mounting bolt | 36 | bracket mounting bolt |
| 38 | main bracket | 40 | upper flange |
| 42 | lower flange | 44 | opening |
| 46 | mounting slot | 48 | enclosure mounting hole |
| 50 | electronics/subwoofer assembly | | |
| 62 | center support | 66 | threaded receiver |
| 68 | power connection | 70 | A/V connection block |
| 72 | TV bracket | 74 | TV bolt |
| 76 | gripping-bracket | 78 | upper notch |
| 80 | lower notch | 82 | locking screw |
| 84 | nut | 86 | pivot bracket |
| 88 | wall | 90 | connector cable |
| 92 | lid. | 94 | chassis |
| 96 | speaker | 98 | resonance chamber |
| 100 | bass port | 102 | port wall |
| 104 | port wall | 110 | center receiver |
| 112 | power supply | 114 | R/F module |
| 116 | amplifier | 118 | shelf |
| 120 | DVR | 122 | multi-channel speaker assembly |
| 130 | tweeter | 132 | receiver/display |
| 134 | cover | 136 | pedestal |
| 138 | alternate speaker assembly | 140 | center section |
| 142 | sliding section | 144 | sliding section |
| 146 | left cover | 148 | center cover |
| 150 | right cover | 158 | coaxial RGB cable |
| 160 | HDMI cable | 162 | combined output |
| 164 | combined input | 166 | audio input |
| 168 | video input | | |

DETAILED DESCRIPTION OF THE INVENTION

Figure 1:
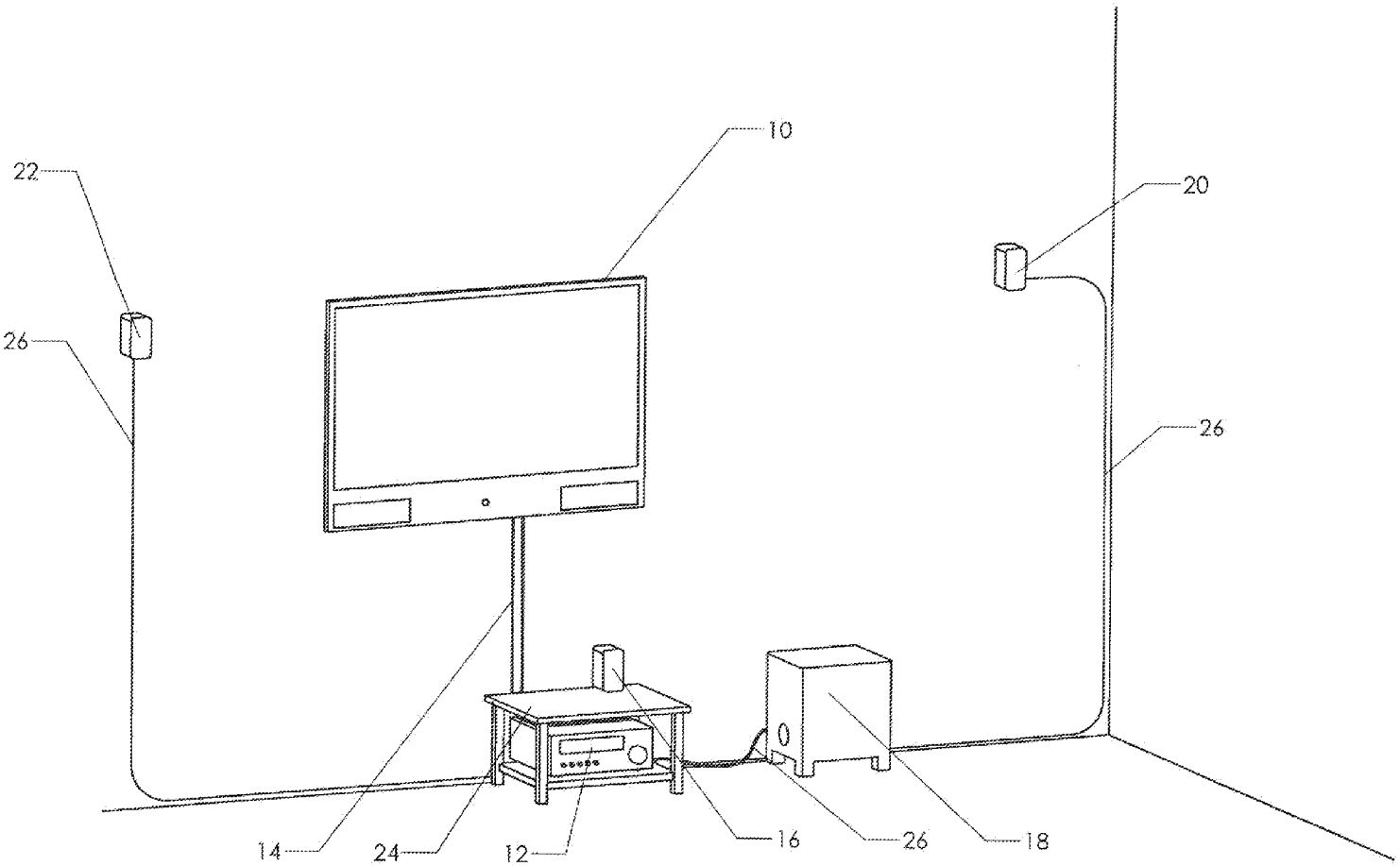
FIG. 1 (PRIOR ART)
FIG. 1 is a perspective view, showing a prior art home theater installation.
Figure 2:
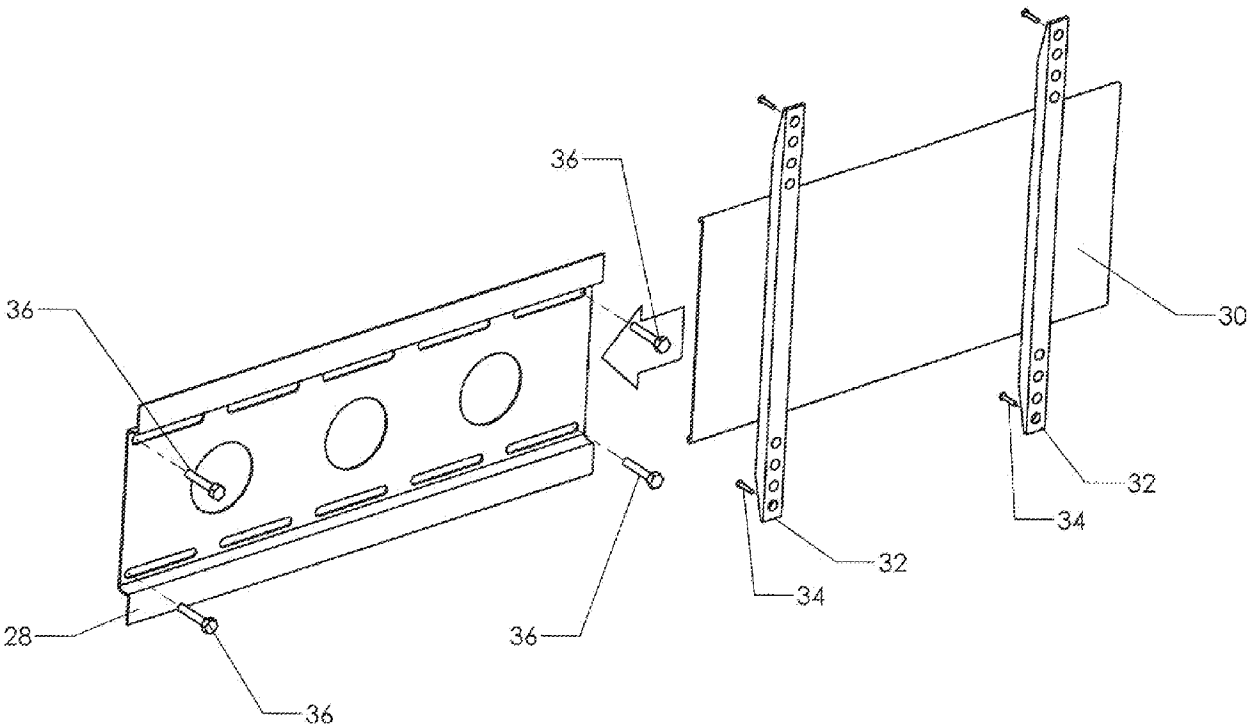
FIG. 2 (PRIOR ART)
FIG. 2 is a perspective view, showing a prior art television mount.
Figure 3:
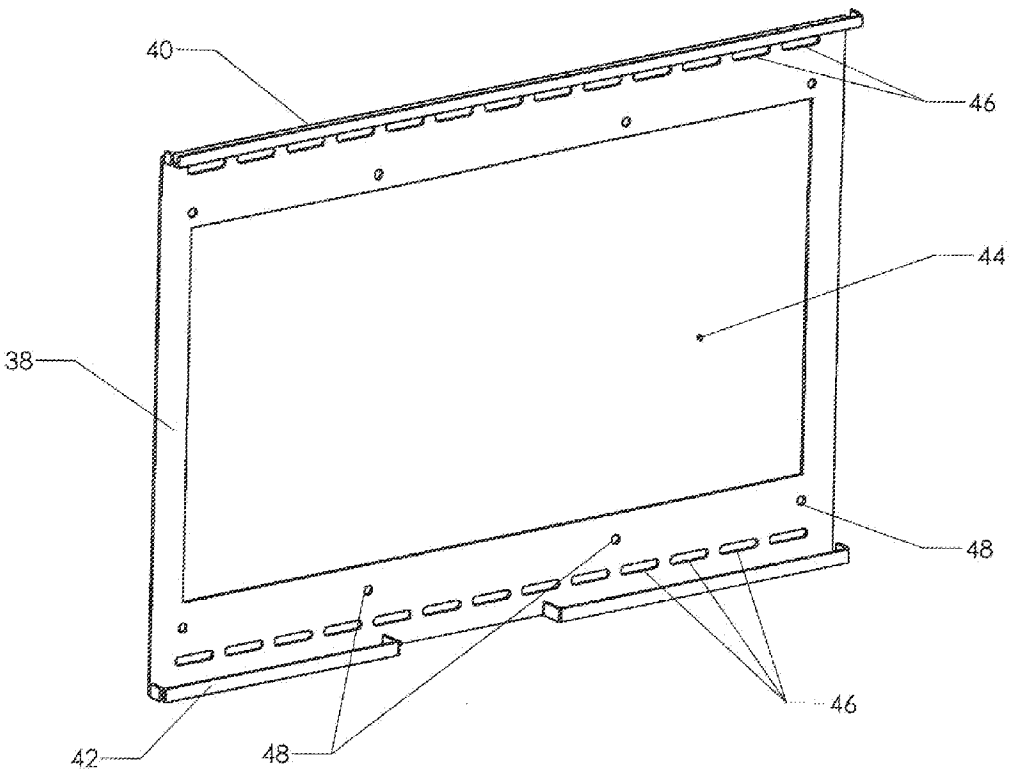
FIG. 3 is a perspective view, showing a wall bracket made according to the present invention.

The present invention integrates a flat screen display and an external audio system into a unified assembly. FIG. 3 shows an embodiment in which the unifying component is main bracket 38. This component includes upper flange 40 and two lower flanges 42. The two lower flanges are separated by a central gap. Numerous mounting slots 46 are provided to that the user may attach screws or bolts through these slots and attach main bracket 38 to a wall (as is known for prior art mounting brackets). These mounting slots 46 may also be used to attach main bracket 38 to a pedestal so that the unit may be placed on a flat surface.

Enclosure mounting holes 48 are provided so that an electronics enclosure may be attached to main bracket 38. One or more openings are preferably provided through the main bracket so that audio and/or video cables may be easily passed through the bracket. In the embodiment shown in FIG. 3, a single large opening 44 is provided for this purpose.

Figure 4:
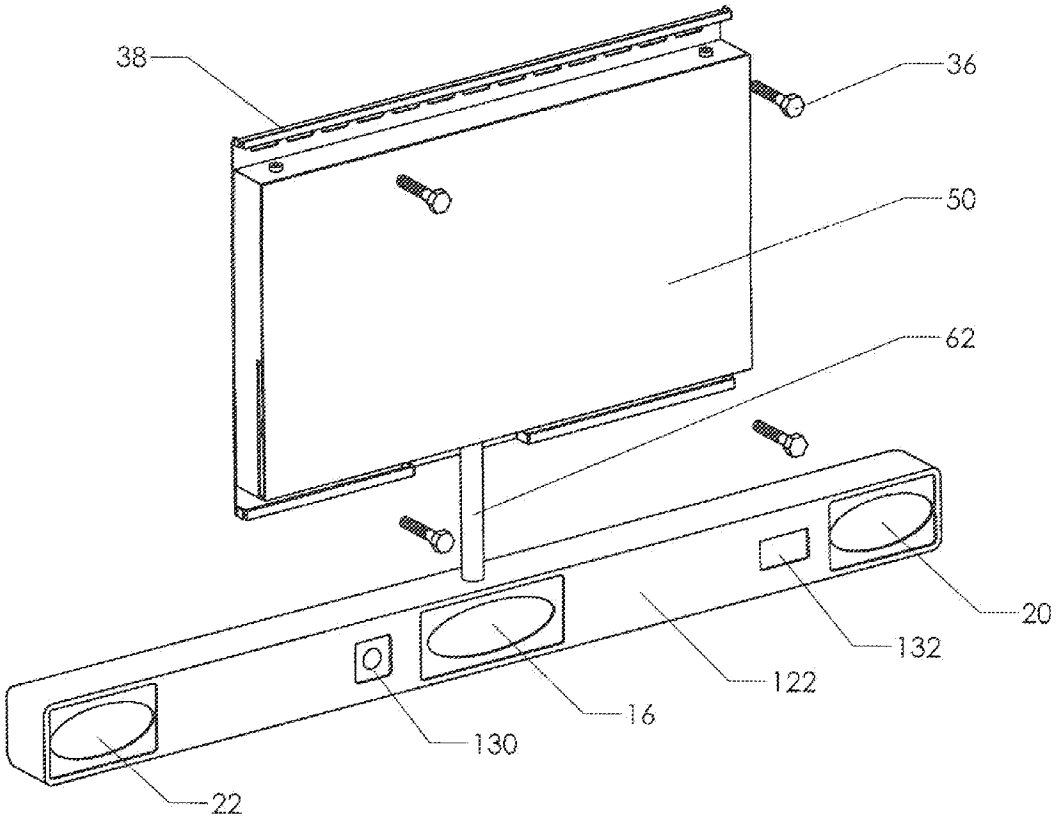
FIG. 4 is a perspective view, showing the addition of an electronics/subwoofer enclosure, speaker support, and speakers to the wall bracket.

In FIG. 4, electronics/subwoofer assembly 50 has been attached to main bracket 38. The electronics/subwoofer assembly preferably contains an audio amplifier and an integrated bass speaker mounted in a single enclosure (though the bass speaker could be mounted outside the enclosure as well). Other components may be included. The combination of main bracket 38 and electronics/subwoofer assembly 50 is referred to as an "integration assembly." This phrase is intended to encompass the many different ways that the electronics may be integrated with the main bracket. As one example, those skilled in the art will know that the main bracket could actually form part of the electronics enclosure (such as by having the flat plate of the main bracket be the base of the enclosure).

A speaker support is provided for an external speaker. In the embodiment of FIG. 4, center support 62 is the speaker support. This component is connected to the integration assembly. In the embodiment shown, center support 62 is actually connected to electronics/subwoofer assembly 50, but the connection to the integration assembly could be made in many different ways.

The speaker support is preferably adjustable in terms of extension. It can slide in and out of the integration assembly in order to raise or lower the speaker assembly. The speaker support may also be pivotally adjustable.

Multi-channel speaker assembly 122 is attached to center support 62. The multi-channel speaker assembly preferably includes three main speakers. These are: left channel speaker 22, center channel speaker 16, and right channel speaker 20. Tweeter 130 may also be provided. Electronics/subwoofer assembly 50 contains (or is connected to) another speaker intended to handle low frequencies.

The electronic devices within electronics/subwoofer assembly 50 preferably divide the available audio signals into the left, center, and right channels. The low frequency speaker ("subwoofer") preferably transmits the low frequency audio for all the channels—since low frequency audio does not tend to be directionally specific.

Multi-channel speaker assembly 122 preferably contains additional elements as well. Receiver/display 132 is a small video display (such as a back lit color LCD) which provides information as to the status of electronics/subwoofer assembly 50. For example, the display can inform the user of the current Bass and Treble settings, as well as the active mode. The receiver/display preferably also includes a remote control receiver for receiving signals sent by a remote control. Electronics/subwoofer assembly 50 will be concealed behind a flat screen television when the device is in operation. Receiver/display 132 is located below the bottom of the television so that it will be accessible to remote control signals intended for the electronics/subwoofer assembly. The receiver/display is electrically connected to the electronics/subwoofer assembly so that data may be freely exchanged between the two.

It is preferable to provide an electronics/subwoofer assembly which may be attached to the main bracket before the main bracket is attached to the wall or a pedestal. FIG. 4 shows such a version. The reader will note that electronics/subwoofer assembly 50 does not obstruct the mounting slots 46 on main bracket 38. Thus, a user is able to take the entire assembly shown in FIG. 4 and attach it to a wall (or pedestal) by passing several bracket mounting bolts 36 through the mounting slots 46 in main bracket 38. This may be done before or after the supports and associated speaker assemblies are installed.

Figure 5:
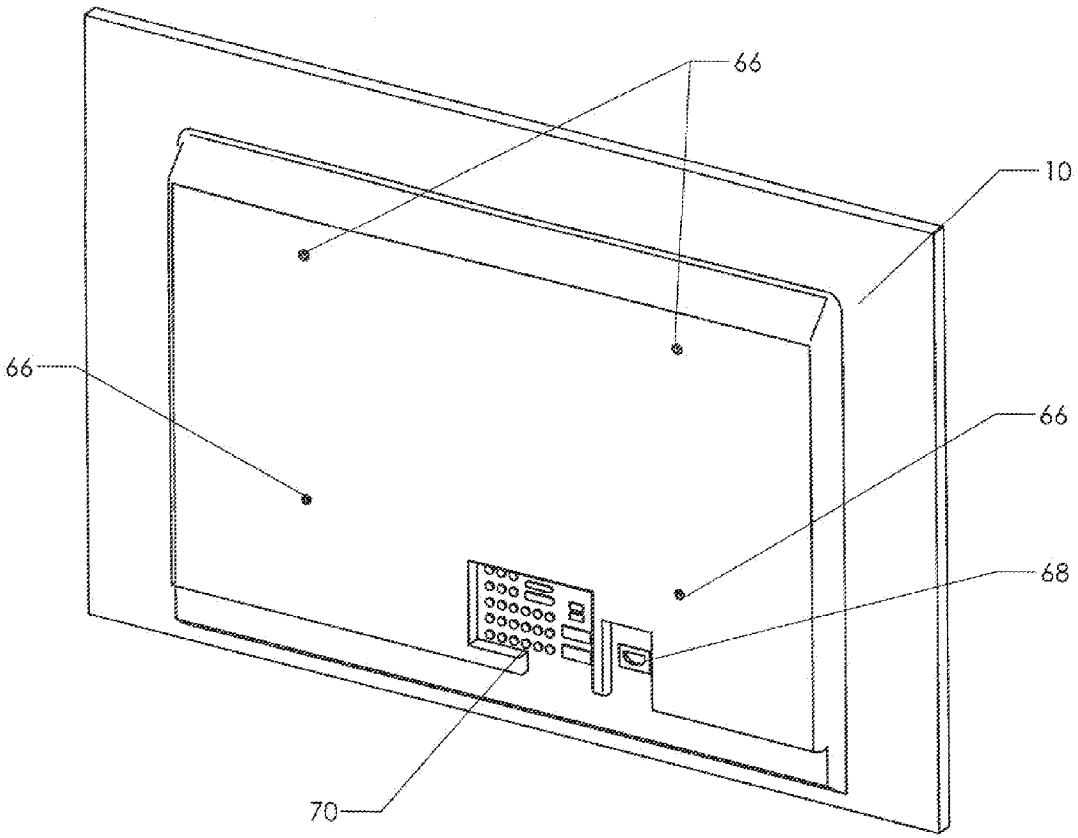
FIG. 5 is a perspective view, showing the rear of a typical flat screen display.

Once the main bracket is in position, the user will wish to attach the flat screen display. FIG. 5 shows flat screen display 10 from the rear. The rear of such a television typically includes four or more threaded receivers 66. These are strong mounting points provided for the attachment of the television to a supporting bracket.

The rear of the television typically also includes A/V connection block 70 and power connection 68. The power connection allows a power cord to be plugged in. The A/V connection block typically provides for the connection of multiple cables of multiple types, including: HDMI, DVI, component video, S-video, composite video, RGB/VGA, and digital optical. The mounting system should provide access to the A/V connection block and the power connection.

Figure 6:
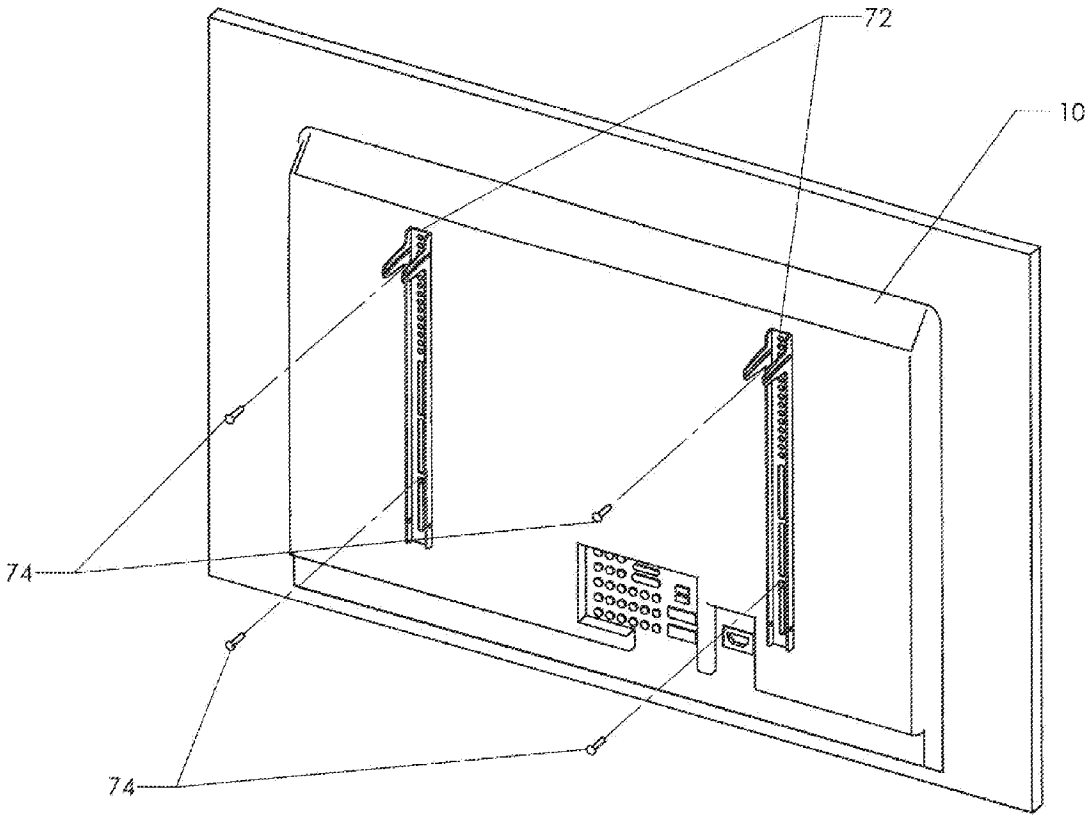
FIG. 6 is a perspective view, showing the addition of a pair of TV brackets to the rear of a flat screen display.
Figure 7:
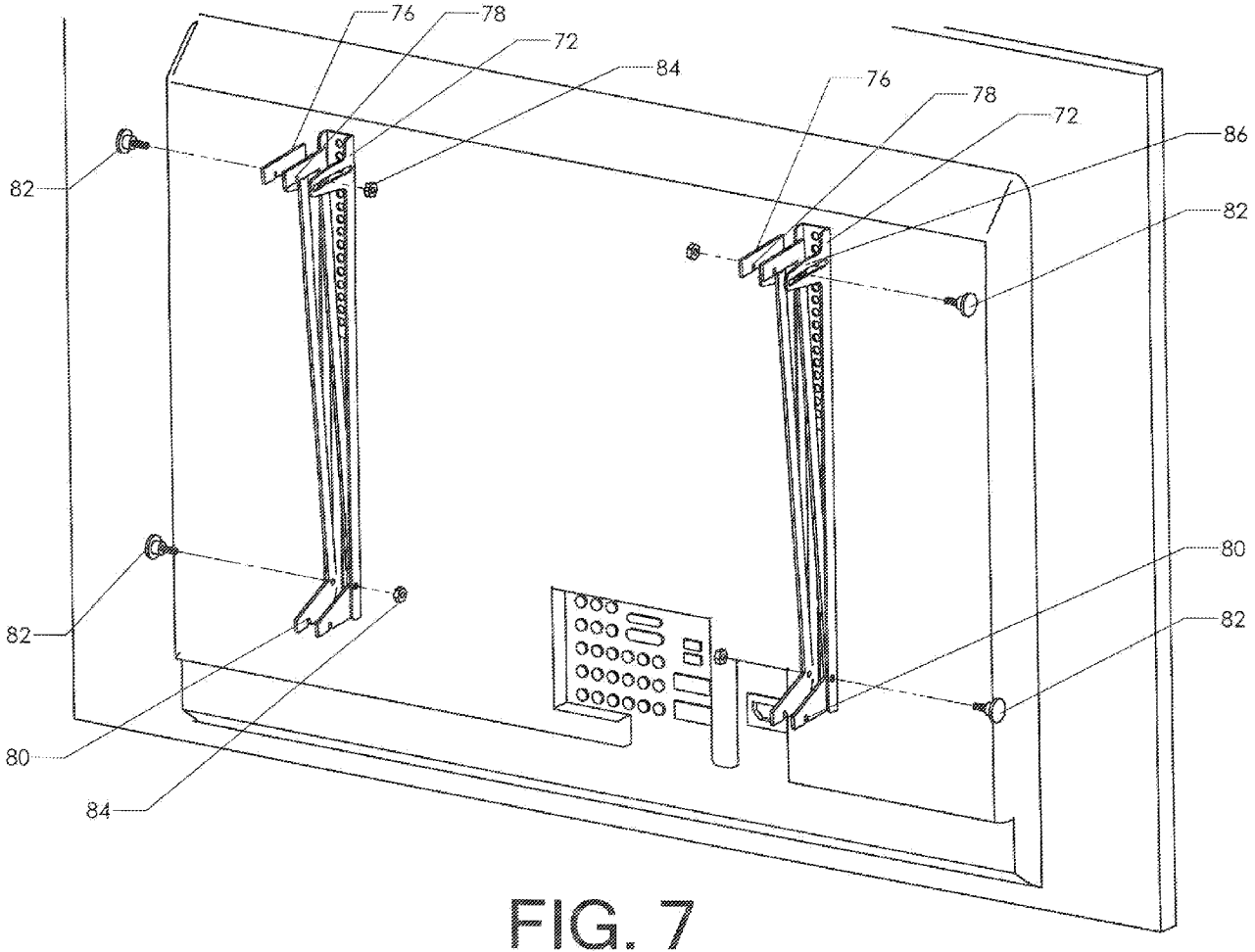
FIG. 7 is a perspective view, showing the addition of a gripping bracket to each TV bracket.
Figure 10:
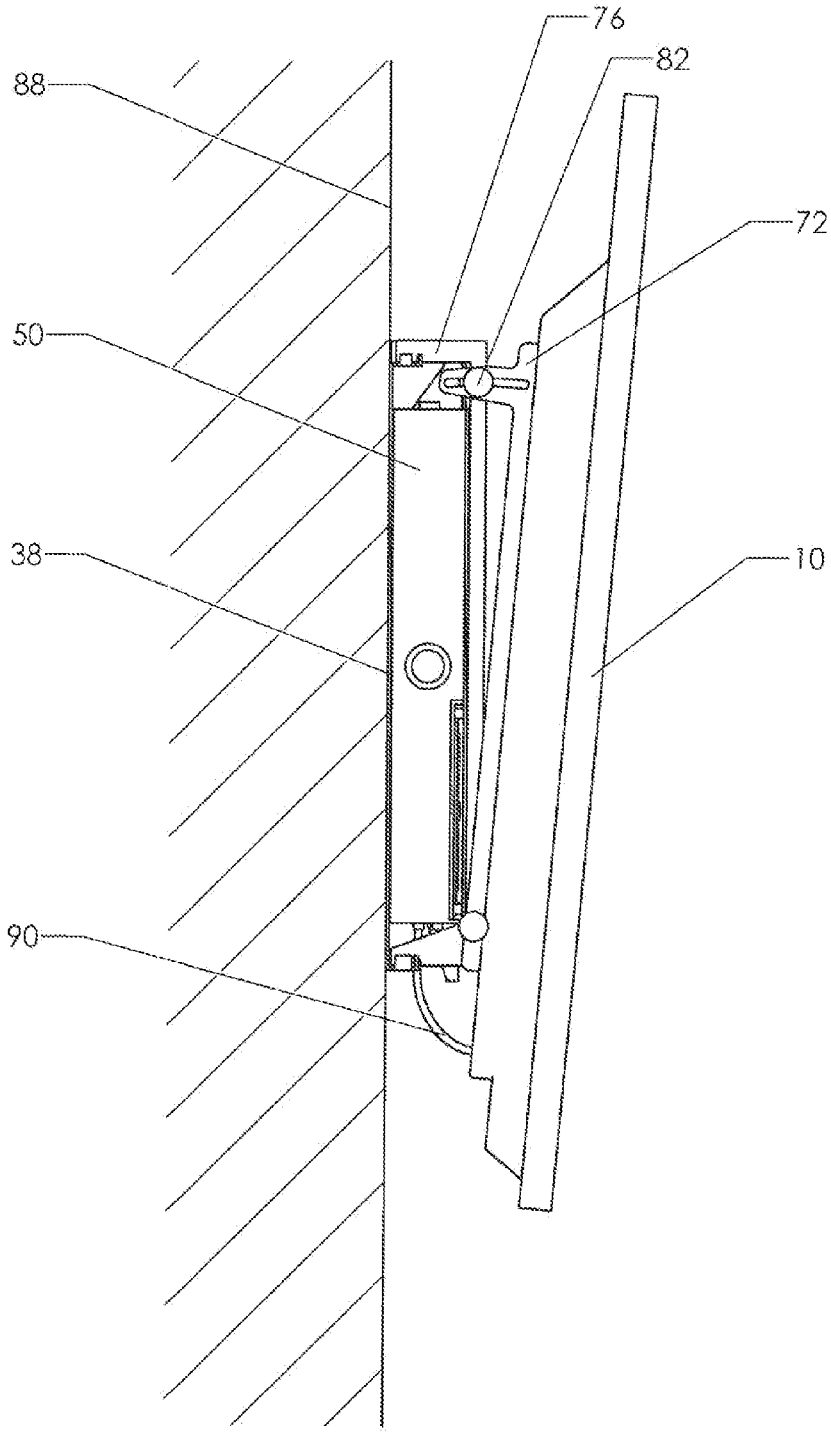
FIG. 10 is an elevation view, showing the placement of the components behind the flat screen display.

The physical connection made between the television and the main bracket can assume a virtually endless variety of forms. Thus, the embodiment shown in FIGS. 6, 7, and 10 is properly viewed as exemplary. In the embodiment of FIG. 6, a pair of TV brackets 72 are connected to the back of flat screen display 10 by passing TV bolts 74 through the TV brackets and into the threaded receivers 66 in the back of the TV.

In FIG. 7, a gripping bracket 76 is shown attached to each of the TV brackets 72. Each gripping bracket pivots around a locking screw 82 which is passed through a hole through the gripping bracket and the TV bracket. The upper portion of each TV bracket includes a pivot bracket 86 with a slot. The upper portion of each gripping bracket 76 is secured by passing a locking screw 82 through the pivot bracket and through a hole in the upper portion of the gripping bracket. Nuts 84 are engaged by the locking screws.

The reader will thereby appreciate that each gripping bracket 76 may be pivoted with respect to its connected TV bracket 72. The desired pivot position may then be secured by tightening the appropriate locking screw 82. The design shown allows the reader to adjust the tilt of the television after it is attached to the main bracket—as will be explained subsequently.

The two gripping brackets 76 are provided with features allowing them to be fastened to main bracket 38. The reader will note that the upper portion of each gripping bracket has an extension extending toward the rear. This extension includes an upper notch 78. The lower portion of each gripping bracket likewise includes a lower notch 80. The upper notches are sized and positioned to slip over and engage upper flange 40 on main bracket 38 while the lower notches are sized and positioned to slip over and engage lower flange 42 on main bracket 38. The notches preferably have a tapered entry, fillets, or other similar features to help the user engage the gripping brackets with the main brackets.

Figure 8:
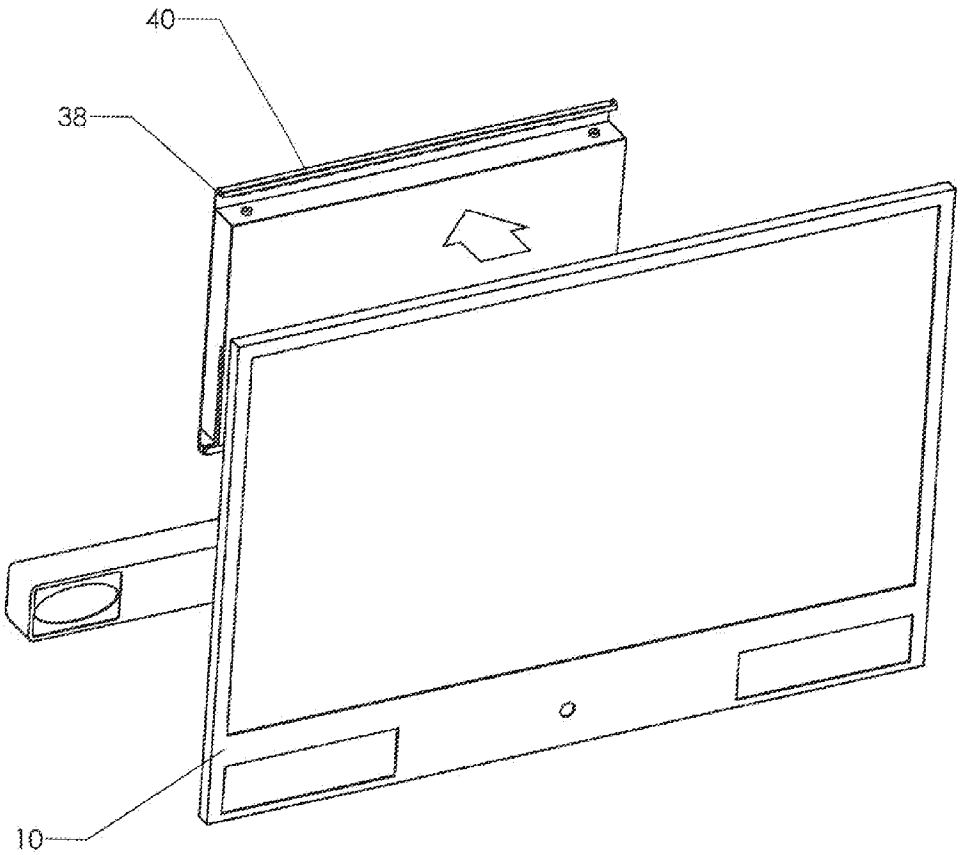
FIG. 8 is a perspective view, showing the attachment of a flat screen display to the wall bracket.

Turning now to FIG. 8, the reader will observe that main bracket 38 with its attached electronics/subwoofer assembly and speaker assembly has been attached to a wall. The appropriate mounting brackets (TV brackets and gripping brackets) have been attached to the rear of flat screen display 10. The user moves the flat screen display toward the integration assembly as shown by the arrows. He or she slips the upper notches 78 over the upper flange 40 and the lower notches 80 over the lower flange 42 in order to attach the TV to main bracket 38.

Figure 9:
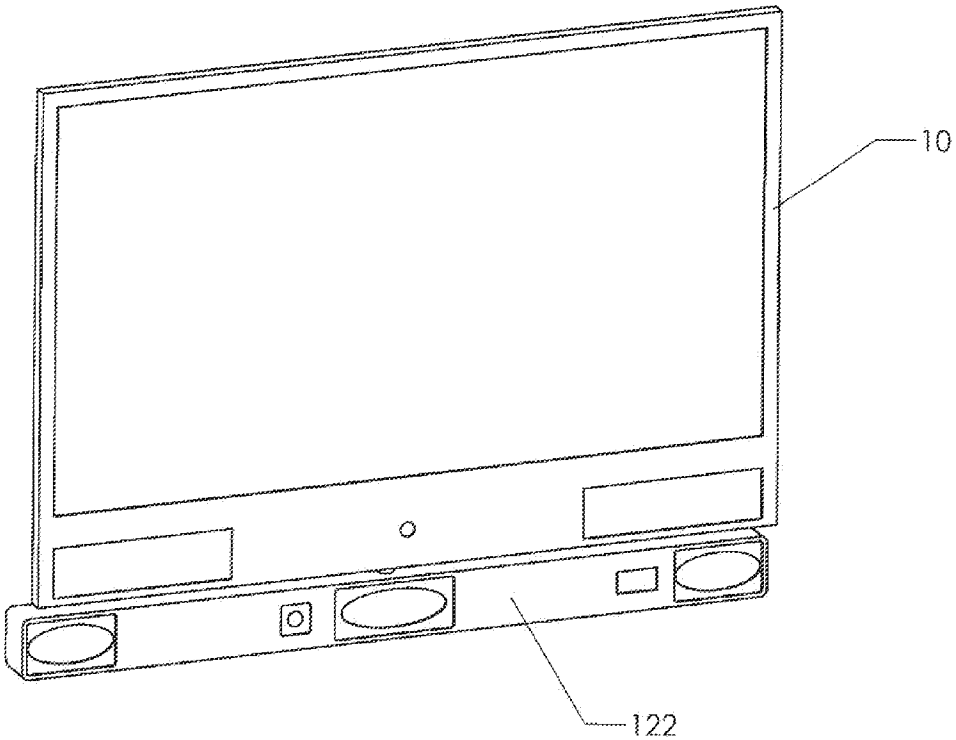
FIG. 9 is a perspective view, showing a flat screen display attached to the present invention.

FIG. 9 shows the assembly with flat screen display 10 in position. Multi-channel speaker assembly 122 is positioned by sliding it up or down to the position the user desires. Prior to installing the TV the user will typically extend center support 62 to move the speakers will clear of the TV. Once the TV is in position and adjusted, the user may then push the speaker assembly up against the perimeter of the TV and lock it into position using a suitable locking feature. Alternatively, center support 62 may include frictional or other features which allow it to be adjusted but maintain position once the adjustment is made.

FIG. 10 shows a side elevation view of the assembly mounted on the wall without multi-channel speaker assembly 122. Main bracket 38 is attached to wall 88. The reader will observe how the notches in the gripping brackets are engaged over the upper and lower flanges in main bracket 38. The reader will also observe how the tilt of the TV may be adjusted without removing it from main bracket 38. Tilt may be adjusted by reaching in from the side and loosening locking screws 82, repositioning the TV, and then retightening the locking screws.

FIG. 10 shows how electronics/subwoofer assembly 50 neatly fits into the available space between flat screen display 10 and wall 88. Room is also available to connect the electronics/subwoofer assembly 50 with the TV, if the installation is a type requiring such a connection. In the example shown, connector cable 90 connects electrical components within the electronics/subwoofer enclosure to flat screen display 10.

The specific design of the mounting bracketry is not significant to the present invention. Thus, the reader should bear in mind that the invention includes many different types of mounting arrangements that may appear and function in different ways from the illustrated embodiments.

Figure 11:
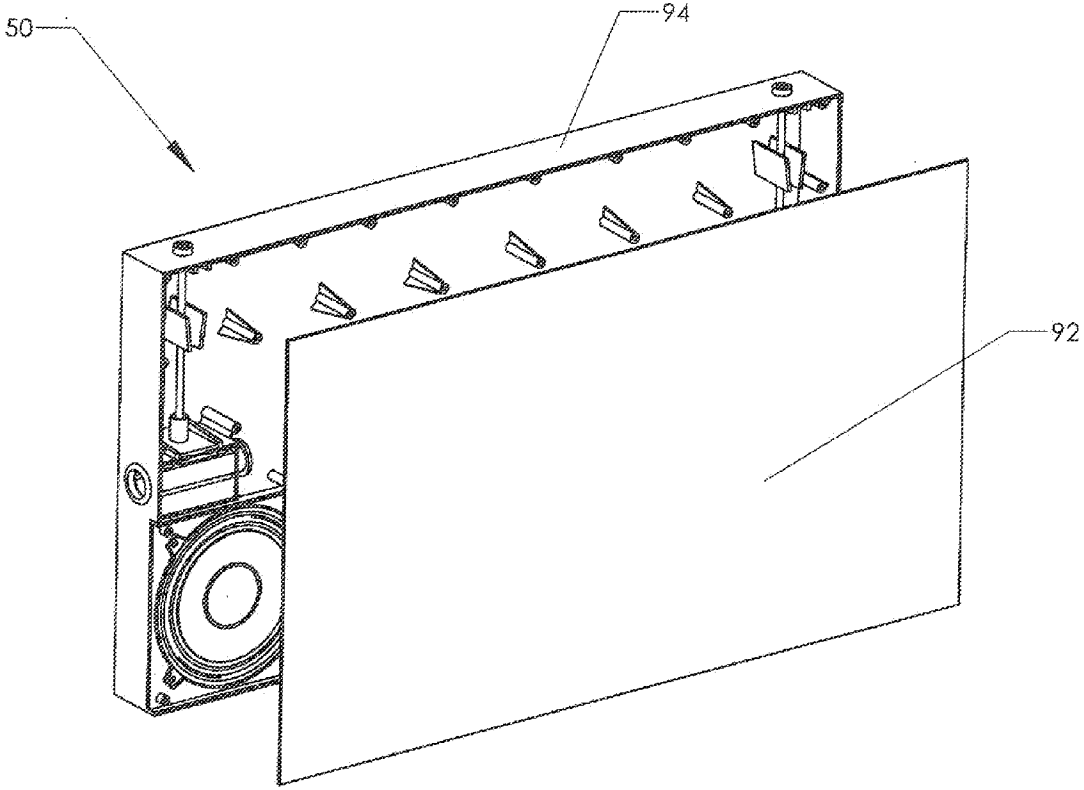
FIG. 11 is an exploded perspective view, showing the electronics/subwoofer enclosure.

Likewise, the design of the electronics enclosure may assume many forms. However, as it may aid the reader's understanding, a detailed description of one embodiment will be provided. FIG. 11 shows an exploded view of electronics/subwoofer enclosure 50. Chassis 94 contains the components. It is covered by lid 92, which may be snapped or screwed into place. These components may be made of fiber-reinforced thermoplastic, metal, or other suitable materials.

Figure 12:
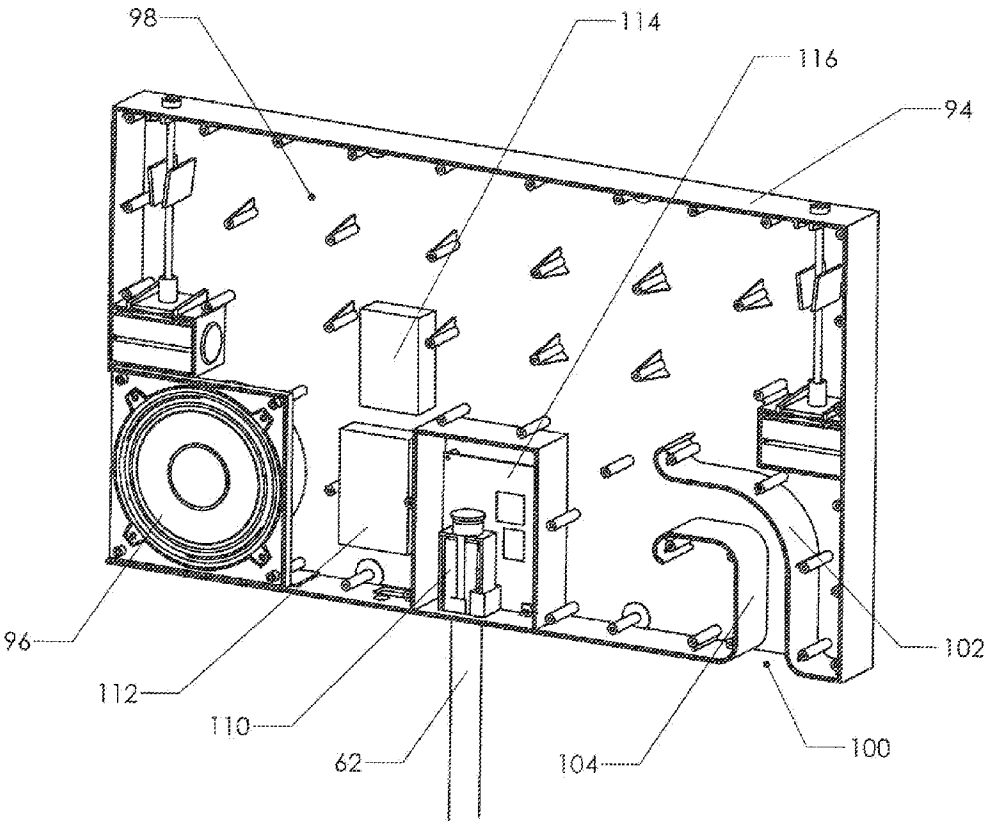
FIG. 12 is a perspective view, showing the interior of the electronics/subwoofer enclosure.

FIG. 12 shows chassis 94 with the lid fully removed. The chassis includes interior bulkheads surrounding amplifier 116. Speaker 96 preferably performs the role of a "subwoofer," meaning that it is designed to handle relatively low frequency sounds. It is sometimes alternatively referred to as a "bass speaker." The output of bass speaker 96 is open to the interior of the chassis. The interior forms a resonance chamber 98. The chassis also includes bass port 100 bounded by port wall 102 and port wall 104. The bass port is positioned to emit relatively low frequency tones generated by bass speaker 96.

The chassis includes other features as well. In the embodiment shown, the speaker support (center support 62)) is attached to the electronics/subwoofer assembly itself. This need not always be the case as it could be attached directly to main bracket 38 or some other component. However—in the embodiment shown—center support 62 is slidably and pivotally received within center receiver 110.

As stated previously, the receiver is preferably equipped with frictional features which allow adjustment but tend to retain the speaker assembly in position once the user releases it. One example of a frictional fit is to make the speaker support tubular and provide the receivers with NYLON bushings which fit tightly around the tubes.

Other components may be contained within the chassis. Power supply 112 provides power to amplifier 116. R/F module 114 may be provided to supply wireless outputs to some or all of the speakers. The connections between the audio amplifier and the left, right, and center speaker assemblies may be hard-wired, wireless, or a mixture of the two.

Amplifier 116 may assume many forms. In some instances it may be a pass-through device which simply passes through the channel-specific signals received from an external surround-sound amplifier. In other instances it may itself be a sophisticated surround sound amplifier which receives an input signal from a cable or satellite feed and splits that signal into the appropriate channels, including, left, right, center, and rear.

In some versions the amplifier may receive its input from the flat screen display. In other versions the amplifier will receive its input from an external cable or satellite decoder (or other video/audio data source) with no connection being made between the amplifier and the TV itself.

Figure 13:
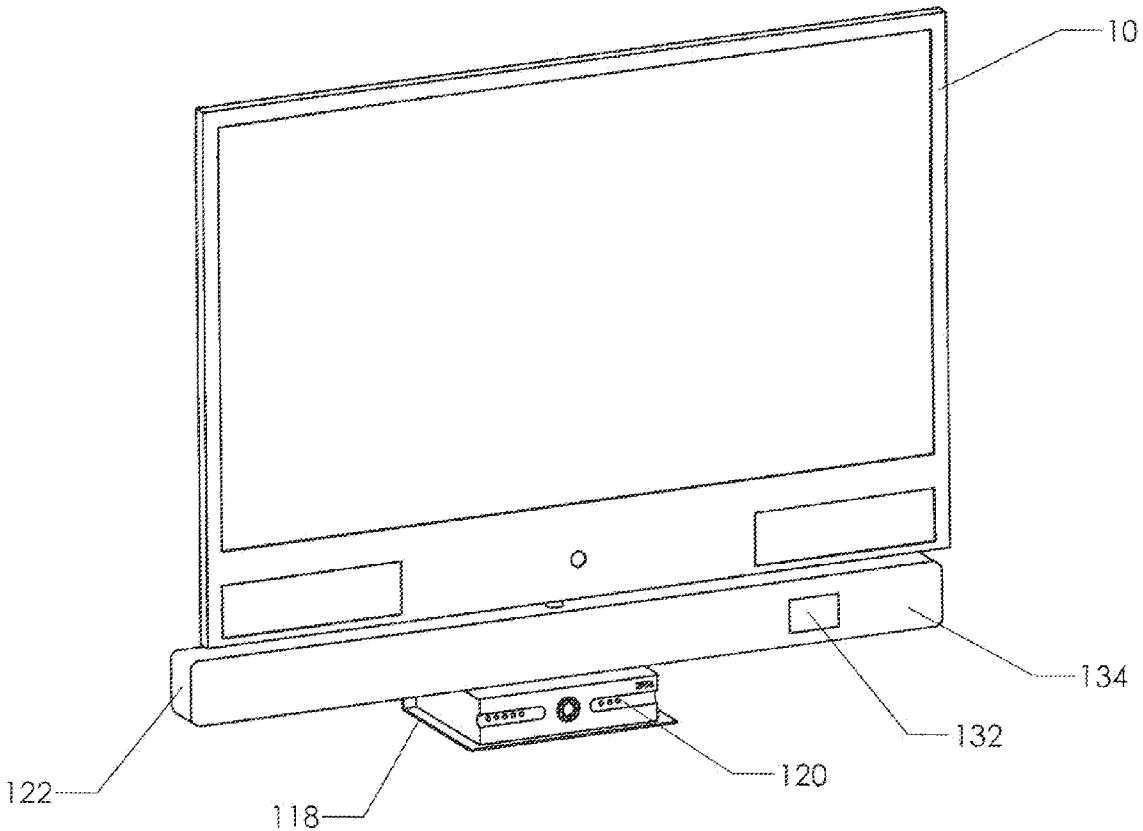
FIG. 13 is a perspective view, showing the present invention in place with an optional suspended shelf.

Other features may be added to the integrated system. FIG. 13 shows an embodiment in which suspended shelf 118 has been added beneath multi-channel speaker assembly 122 (Note that a conventional cover 134 has been placed over the speakers for aesthetic purposes). The shelf may be attached to a suitable point such as center support 62 or the speaker assembly itself. Another component, such as a digital video recorder, may be placed on the shelf. In some embodiments the electronics/subwoofer enclosure will include electrical connections for many different types of components, including DVR's and DVD players.

The specific speaker configurations and positions shown in the invention should not be viewed as limiting. In some embodiments the speaker assembly could be placed above the flat screen display or even to one side.

Figure 14:
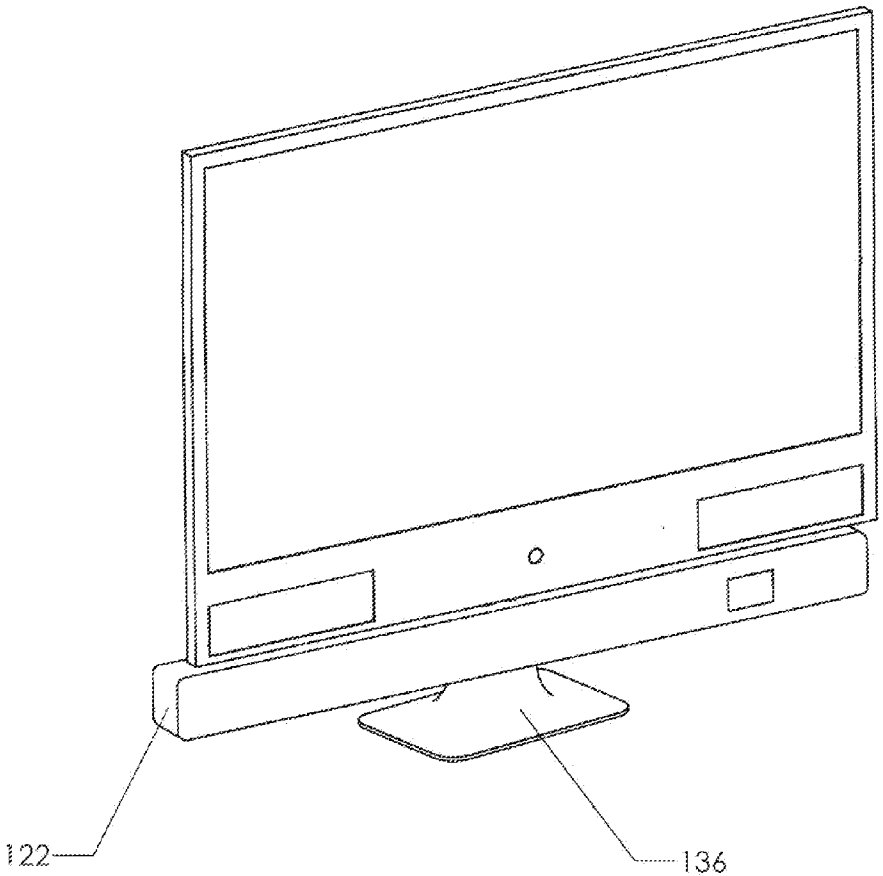
FIG. 14 is a perspective view, showing an alternate embodiment in which a pedestal is added to the present invention.

As disclosed previously, main bracket 38 may be configured to mount to a wall or to a pedestal. It is even possible to provide a main bracket which can be optionally attached to either a wall or a pedestal. FIG. 14 shows an embodiment in which the main bracket has been attached to pedestal 136 and the entire assembly has been placed upon a horizontal surface. In such a case the main bracket may not look like the example shown in FIG. 3 but may instead assume a different form.

Figure 15:
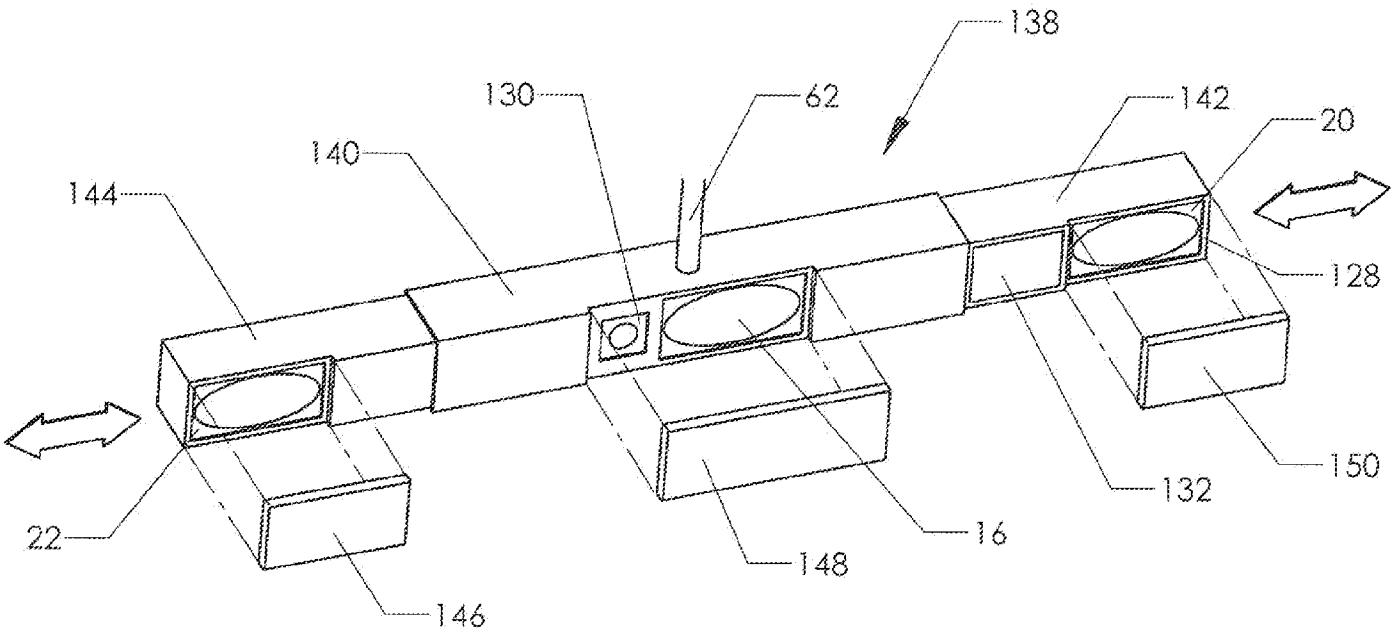
FIG. 15 is a perspective view of an alternate embodiment in which the lateral spacing of the left and right speakers is adjustable.

FIG. 15 shows an alternate embodiment in which the left and right channel speakers may be laterally adjusted with respect to the speaker support. Sliding section 144—which houses left channel speaker 22—slides in and out of center section 140. Sliding section 142—which houses right channel speaker 20—also slides in and out of center section 140. Three separate covers are provided for the speakers themselves. These are left cover 146, center cover 148, and right cover 150. As those skilled in the art will know, the covers are made from a material which is visually opaque but is "noise transparent" so that the covers do not appreciably alter the noise produced by the speakers.

Figure 16:
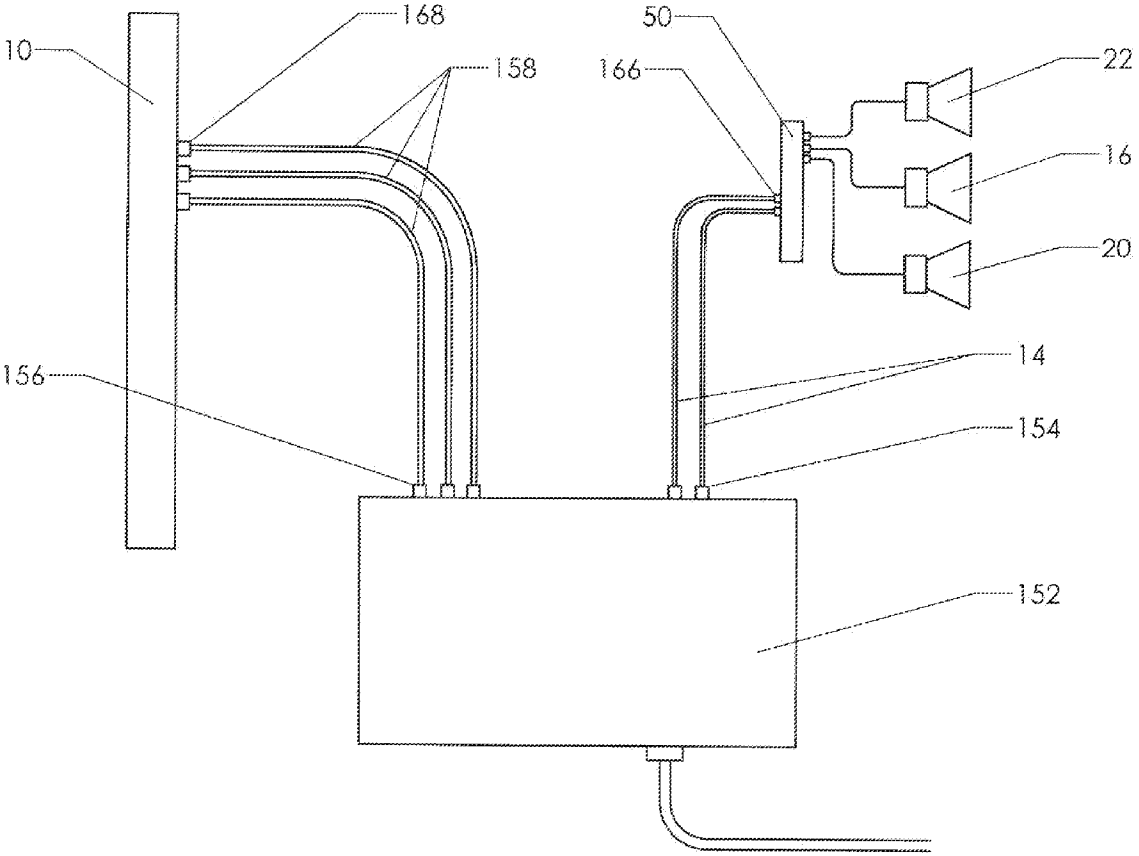
FIG. 16 is a schematic view, showing one possible connection scheme for the components that may be used with the present invention.
Figure 17:
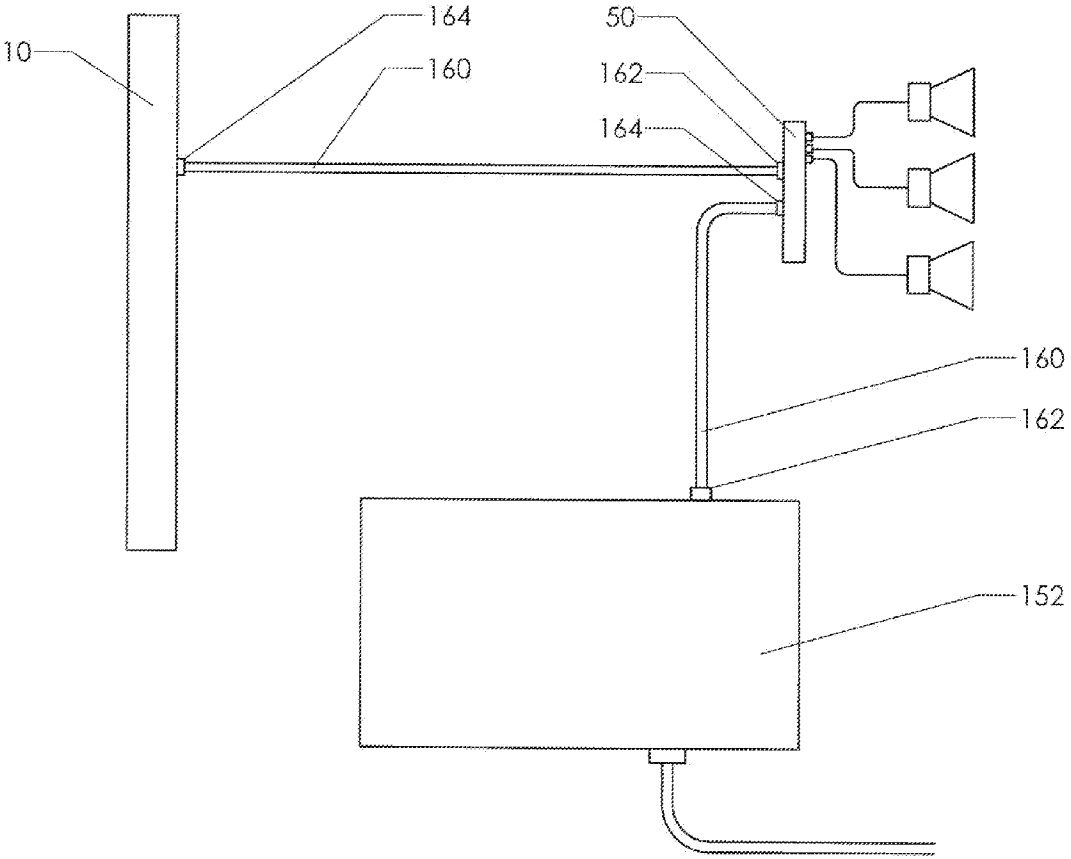
FIG. 17 is a schematic view, showing another possible connection scheme for the components that may be used with the present invention.

As stated previously, the electronics/subwoofer assembly can be configured to support a wide variety of connections to other components. While these are well known in the art, FIGS. 16 and 17 provide two illustrative examples which will benefit the reader's understanding. In FIG. 16, video/audio output source 152 is any device producing a video and audio signal where the two signals are intended to correspond (meaning that the audio signal is synchronized in time to the video signal being shown). Synchronization in time includes examples of a natural link—such as the spoken sounds precisely corresponding to a video image of someone talking. It may also include examples of a created link—such as a selected piece of music accompanying a video which is unrelated to the music (An example would be classical music accompanying scenes of nature). There are many different types of video/audio output sources. Examples include cable TV set top boxes, satellite TV set top boxes, and DVD players.

A typical output of such devices is a five cable array. Two of these cables carry audio while three carry video. The two audio cables are a left audio channel and a right audio channel. The three video cables carry separate red, blue, and green signals. Two audio cables 14 are connected to audio output 154. In the example of FIG. 16, these are connected to audio input 166 on electronics/subwoofer assembly 50. Three coaxial RGB cables 158 are connected between video output 156 and video input 168 on video display 10.

Thus—in the example of FIG. 16—electronics/subwoofer assembly 50 receives only the audio signal and does not receive the video signal. It may, however, be deemed more convenient to pass all five connections through the electronics/subwoofer assembly. This is particularly true where a single cable having all five connections is used (a ribbon cable in which five coaxial cables are linked laterally). In such an embodiment the electronics/subwoofer assembly would have input jacks for all five cables and output jacks for all five cables. The video signal would simply be passed through.

HDMI cables provide a unified connection for all the video and audio components of a high definition signal. FIG. 17 shows an embodiment intended for use with HDMI cables. HDMI cable 160 connects combined output 162 on video/audio output source 152 to combined input 164 on electronics/subwoofer assembly 50. A second HDMI cable 160 is then used to connect combined output 162 on electronics/subwoofer assembly 50 to combined input 164 on video display 10. It is preferable to provide the electronics/subwoofer assembly with multiple jacks of different types, thereby allowing it to be connected in several different ways.

The preceding description contains significant detail regarding the novel aspects of the present invention. It should not be construed, however, as limiting the scope of the invention but rather as providing illustrations of the preferred embodiments of the invention. As an example, although the illustrated embodiments show a design wherein the bass speaker is mounted within the electronics/subwoofer enclosure, the bass speaker could actually be mounted adjacent to the electronics enclosure in a completely separate enclosure. Thus, the scope of the invention should be fixed by the following claims, rather than by the examples given.

Having described our invention, we claim:

1. An integrated audio visual entertainment system, comprising:

a. a main bracket configured to mount on a wall;
b. an electronics/subwoofer assembly connected to said main bracket to form an integration assembly;
c. a speaker support connected to said integration assembly;
d. a speaker assembly connected to said speaker support;
e. a video display, said video display having a back, with said back including a plurality of threaded receivers;
f. a second bracket connected to said video display by a plurality of TV bolts passing through said second bracket and into said plurality of threaded receivers in said back of said video display;
g. said second bracket being releasably attached to said main bracket with said attachment being possible while said main bracket is mounted on said wall;
h. said electronics/subwoofer assembly including,
   i. a bass speaker,
   ii. a resonance chamber with an output of said bass speaker being open to said resonance chamber,
   iii. a bass port connected to said resonance chamber and leading out of said resonance chamber,
   iv. an audio amplifier, separate from said video display, said audio amplifier receiving an audio signal corresponding to a video signal being displayed on said video display;
i. wherein a speaker in said speaker assembly is connected to said audio amplifier and said bass speaker is connected to said audio amplifier; and
j. wherein said integration assembly lies completely behind said video display.

2. An integrated audio visual entertainment system as recited in claim 1, wherein:

a. said integration assembly includes a vertically oriented center receiver; and
b. said speaker support slides in and out of said vertically oriented center receiver in order to adjust the position of said speaker assembly with respect to said integration assembly.

3. An integrated audio visual entertainment system as recited in claim 1, wherein said speaker assembly includes a remote control receiver which receives commands from a remote control and conveys said commands to said electronics/subwoofer assembly.

4. An integrated audio visual entertainment system as recited in claim 1, wherein said speaker assembly further comprises a second video display providing information regarding the operation of said electronics/subwoofer assembly.

5. An integrated audio visual entertainments system as recited in claim 1, further comprising a shelf attached to said integration assembly.

6. An integrated audio visual entertainment system as recited in claim 1, wherein:

a. said speaker support includes a hollow conduit; and
b. said connection between said speaker in said speaker assembly and said audio amplifier is made by a conductor passing through said hollow conduit.

7. An integrated audio visual entertainment system as recited in claim 1, wherein said speaker assembly'includes:

a. a second speaker, said second speaker being laterally adjustable with respect to said center support; and
b. a third speaker, said third speaker being laterally adjustable with respect to said center support.

8. An integrated audio visual entertainment system, comprising:

a. a main bracket configured to mount vertically;
b. an electronics/subwoofer assembly connected to said main bracket;
c. a speaker support connected to said electronics/subwoofer assembly;
d. a first speaker assembly connected to said speaker support;
e. a video display, said video display having a back;
f. a second bracket attached to said back of said video display;

g. said second bracket releasably connecting said video display to said main bracket;

h. said electronics/subwoofer assembly including, i. a bass speaker, ii. an audio amplifier separate from said video display, said audio amplifier receiving an audio signal corresponding to a video signal being displayed on said video display;

i. wherein said first speaker assembly is connected to said audio amplifier and said bass speaker is connected to said audio amplifier; and j. wherein said main bracket and said electronics/subwoofer assembly lies completely behind said video display.

9. An integrated audio visual entertainment system as recited in claim 8, wherein:

a. said electronics/subwoofer assembly includes a vertically oriented center receiver; and b. said speaker support slides in and out of said vertically oriented center receiver in order to adjust the position of said speaker assembly with respect to said electronics/subwoofer assembly.

10. An integrated audio visual entertainment system as recited in claim 8, wherein said speaker assembly includes a remote control receiver which receives commands from a remote control and conveys said commands to said electronics/subwoofer assembly.

11. An integrated audio visual entertainment system as recited in claim 8, wherein said speaker assembly further comprises a second video display providing information regarding the operation of said electronics/subwoofer assembly.

12. An integrated audio visual entertainments system as recited in claim 8, further comprising a shelf attached to said main bracket.

13. An integrated audio visual entertainment system as recited in claim 8, wherein:

a. said speaker support includes a hollow conduit; and b. said connection between said speaker in said speaker assembly and said audio amplifier is made by a conductor passing through said hollow conduit.

14. An integrated audio visual entertainment system as recited in claim 8, wherein said speaker assembly includes:

a. a second speaker, said second speaker being laterally adjustable with respect to said speaker support; and b. a third speaker, said third speaker being laterally adjustable with respect to said speaker support.

15. An integrated audio visual entertainment system, comprising:

a. a main bracket configured to mount vertically;

b. an electronics enclosure connected to said main bracket to form an integration assembly;

c. a speaker support connected to said integration assembly;

d. a first speaker assembly connected to said speaker support;

e. a video display, said video display having a back;

f. a second bracket attached to said back of said video display, with said second bracket being releasably attached to said integration assembly;

g. said electronics enclosure including an audio amplifier, said audio amplifier being separate from said video display;

h. a bass speaker included in said electronics enclosure;

i. wherein said first speaker assembly is connected to said audio amplifier and said bass speaker is connected to said audio amplifier, with said audio amplifier receiving an audio signal corresponding to a video signal being displayed on said video display; and j. said main bracket and said electronics enclosure lie completely behind said video display.

16. An integrated audio visual entertainment system as recited in claim 15, wherein said speaker support is slidably adjustable with respect to said integration assembly.

17. An integrated audio visual entertainment system as recited in claim 15, wherein said speaker assembly includes a remote control receiver which receives commands from a remote control and conveys said commands to said electronics enclosure.

18. An integrated audio visual entertainment system as recited in claim 15, wherein said speaker assembly further comprises a second video display providing information regarding the operation of said audio amplifier.

19. An integrated audio visual entertainment system as recited in claim 15, further comprising a shelf attached to said integration assembly.

20. An integrated audio visual entertainment system as recited in claim 15, wherein:

a. said speaker support includes a hollow conduit; and b. said connection between said speaker in said speaker assembly and said audio amplifier is made by a conductor passing through said hollow conduit.

* * * * *